US010106357B2

(12) United States Patent
Yoshikawa

(10) Patent No.: US 10,106,357 B2
(45) Date of Patent: Oct. 23, 2018

(54) DISCHARGE DEVICE AND IMAGE FORMING APPARATUS

(71) Applicant: CANON KABUSHIKI KAISHA, Tokyo (JP)

(72) Inventor: Naoki Yoshikawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/158,248

(22) Filed: May 18, 2016

(65) Prior Publication Data

US 2016/0257516 A1 Sep. 8, 2016

Related U.S. Application Data

(62) Division of application No. 14/451,463, filed on Aug. 5, 2014.

(30) Foreign Application Priority Data

Aug. 19, 2013 (JP) ..... 2013-169328

(51) Int. Cl.
*B65H 29/14* (2006.01)
*B65H 5/06* (2006.01)
(Continued)

(52) U.S. Cl.
CPC ..... *B65H 29/14* (2013.01); *B65H 5/06* (2013.01); *B65H 29/70* (2013.01); *B65H 31/00* (2013.01);
(Continued)

(58) Field of Classification Search
CPC .. B65H 29/12; B65H 29/125; B65H 2404/11; B65H 2404/1114; B65H 2404/1116;
(Continued)

(56) References Cited

U.S. PATENT DOCUMENTS 5,188,350 A 2/1993 Hayashi
6,089,567 A * 7/2000 Yatsuhashi ..... B65H 27/00 271/188
(Continued)

FOREIGN PATENT DOCUMENTS

CN 1892472 A 1/2007
CN 102390746 A 3/2012
(Continued)

OTHER PUBLICATIONS

Machine translation of JP 5-178513.*
(Continued)

*Primary Examiner* — Thomas A Morrison
(74) *Attorney, Agent, or Firm* — Fitzpatrick, Cella, Harper & Scinto

(57) ABSTRACT

A discharge device which discharges a sheet includes: a driving shaft which is driven to rotate by a driving source; a plurality of driving rotating members which is provided on the driving shaft; a rotating member which is provided on the driving shaft, has a larger outside diameter than an outside diameter of the driving rotating member, is formed by joining at least two divided components, and includes stepped portions that protrude, to a larger extent, in a radial direction in boundary portions of the at least two components on upstream sides of a rotation direction of the rotating member than on downstream sides thereof; and follower rotating members which are pressed against the driving rotating members.

12 Claims, 6 Drawing Sheets

(51) Int. Cl.
*B65H 29/70* (2006.01)
*B65H 31/00* (2006.01)

(52) U.S. Cl.
CPC .. *B65H 2301/42* (2013.01); *B65H 2301/5122* (2013.01); *B65H 2301/51214* (2013.01); *B65H 2402/5152* (2013.01); *B65H 2404/1118* (2013.01); *B65H 2404/167* (2013.01); *B65H 2801/06* (2013.01)

(58) Field of Classification Search
CPC .... B65H 2404/1118; B65H 2404/1119; B65H 2404/113; B65H 2404/114; B65H 2404/1141; B65H 2404/121; B65H 2404/122; B65H 2404/1231; B65H 2404/133; B65H 2404/2404; B65H 29/14; B65H 29/70; D01H 4/74; D01H 5/74
See application file for complete search history.

(56) References Cited

U.S. PATENT DOCUMENTS

| | | | | |
|---|---|---|---|---|
| 7,566,183 | B2 | 7/2009 | Shoji et al. | |
| 7,703,770 | B2 * | 4/2010 | Ito | B65H 29/14 271/306 |
| 8,220,796 | B2 | 7/2012 | Takahata | |
| 8,544,841 | B2 | 10/2013 | Nakamura | |
| 8,800,987 | B2 | 8/2014 | Kimura et al. | |
| 9,096,406 | B2 | 8/2015 | Kimura et al. | |
| 2006/0170151 | A1 * | 8/2006 | Oshida | B65H 29/22 271/314 |
| 2007/0009308 | A1 | 1/2007 | Shoji et al. | |
| 2008/0001351 | A1 * | 1/2008 | Lee | B65H 29/14 271/306 |
| 2011/0309573 | A1 | 12/2011 | Nakamura | |
| 2013/0187334 | A1 | 7/2013 | Kimura et al. | |
| 2015/0298933 | A1 | 10/2015 | Kimura et al. | |

FOREIGN PATENT DOCUMENTS

| | | | | |
|---|---|---|---|---|
| CN | 103025636 | A | | 4/2013 |
| JP | 5-178513 | | * | 7/1993 |
| JP | 11-208957 | A | | 8/1999 |
| JP | 2002-362808 | A | | 12/2002 |
| JP | 2005-35711 | | * | 2/2005 |
| JP | 2006-151617 | A | | 6/2006 |
| JP | 2007-119110 | A | | 5/2007 |
| JP | 2008-063097 | A | | 3/2008 |
| JP | 2010-228867 | A | | 10/2010 |

OTHER PUBLICATIONS

Machine translation of JP2005-35711.*
Office Action issued in Chinese Patent Application No. 201410407644.2, dated Feb. 25, 2016.
Japanese Office Action dated May 30, 2017, in corresponding Japanese Patent Application No. 2013-169328.

* cited by examiner

DISCHARGE DEVICE AND IMAGE FORMING APPARATUS

This application is a divisional of application Ser. No. 14/451,463, filed on Aug. 5, 2014.

BACKGROUND OF THE INVENTION

Field of the Invention

The present invention relates to a discharge device which discharges a sheet.

Description of the Related Art

In an image forming apparatus in an electrophotographic system, an electrostatic recording system, a magnetic recording system, or the like, an unfixed toner image corresponding to image information is formed and borne on a recording material by an image forming process. The unfixed toner image is thermally fixed onto the recording material by a fixing device as a permanent image, and thereafter the recording material is conveyed to the outside of the apparatus by a discharge device disposed at the outlet part of the fixing device.

In the discharge device, a plurality of discharge rollers is attached to a driving shaft at intervals and the driving shaft is rotated by using a driving source provided in the body of the image forming apparatus. The recording material passes between each of the discharge rollers and a follower roll that is pressed against the corresponding discharge roller, and the material is discharged to the outside of the apparatus.

In some discharge devices, a stiffening roller is provided at a position where the discharge roller is not provided on the driving shaft. The outside diameter of the stiffening roller is greater than that of the discharge roller. In addition, a bend is formed in the recording material due to the difference between the outside diameters of the stiffening roller and the discharge roller. As a result, the recording material has a wave shape when viewed from the downstream side in the conveyance direction. Therefore, loading characteristics of the recording material after being discharged to the outside of the apparatus are enhanced.

Since the outside diameter of the stiffening roller is greater than that of the discharge roller, a difference in circumferential speed occurs between the stiffening roller and the discharge roller when the driving shaft and the stiffening roller are integrally rotated. In order to avoid the difference, the stiffening roller can idle about the driving shaft.

In Japanese Patent Laid-Open No. 2006-151617, attaching (assembling) a stiffening roller to a shaft is not considered.

The present invention has been made to solve the problem described above, and it is desirable to enhance a characteristic of assembling a stiffening rotating member to a shaft.

SUMMARY OF THE INVENTION

A representative configuration of a discharge device according to the present invention is a discharge device which discharges a sheet, and includes: a driving shaft which is driven to rotate by a driving source; a plurality of driving rotating members which is provided on the driving shaft; a rotating member which is provided on the driving shaft, has a larger outside diameter than an outside diameter of the driving rotating member, is formed by joining at least two divided components, and includes stepped portions that protrude, to a larger extent, in a radial direction in boundary portions of the at least two components on upstream sides of a rotation direction of the rotating member, than on downstream sides thereof; and follower rotating members which are pressed against the driving rotating members.

Further features of the present invention will become apparent from the following description of exemplary embodiments with reference to the attached drawings.

DESCRIPTION OF THE EMBODIMENTS

An embodiment of an image forming apparatus provided with a discharge device according to the present invention will be described in detail with reference to the drawings.

First Embodiment

First, the configuration of a first embodiment of the image forming apparatus provided with the discharge device according to the present invention will be described with reference to FIGS. 1 to 4B.

Image Forming Apparatus

Figure 1:
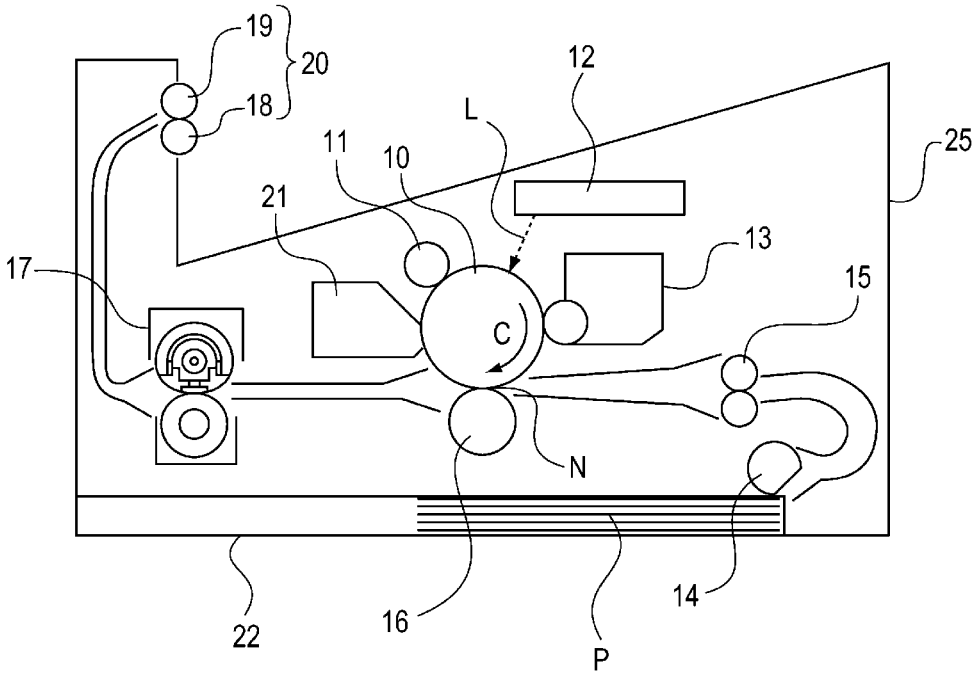
FIG. 1 is a cross-sectional view illustrating the configuration of an image forming apparatus provided with a discharge device according to the present invention.

An image forming apparatus 25 illustrated in FIG. 1 is a laser beam printer using an electrophotographic system. The image forming apparatus 25 forms an unfixed toner image corresponding to image information on a recording material P to be borne thereon by an image forming process. The unfixed toner image is thermally fixed onto the recording material P as a permanent image by a fixing device 17, and thereafter the recording material P as a sheet is conveyed and discharged to the outside of the image forming apparatus 25 (the outside of the apparatus) by a discharge device 20.

The image forming apparatus 25 receives the image information from an image information providing device such as a host computer provided outside. A series of image forming processes of forming and recording the toner image corresponding to the received image information on the sheet-like recording material P are performed by a well-known electrophotographic system.

When the image forming apparatus 25 receives a print signal, recording materials P are separately fed sheet by sheet from a sheet cassette 22 by a feed roller 14 which is driven at a predetermined timing. The feed roller 14 is configured to have a D-shaped cross-section so as not to interfere with the conveyance of the recording material P by coming into contact with the recording material P, after feeding the recording material P. The recording material P which has been fed from the sheet cassette 22 is fed into a transfer nip portion N formed between a photosensitive drum 10 as an image bearing member and a transfer roller 16 as a transfer portion by a registration roller 15 at a predetermined control timing.

Furthermore, when the image forming apparatus 25 receives the print signal, the photosensitive drum 10 starts to rotate. The photosensitive drum 10 has a photoconductive layer as an OPC (Organic Photoconductor) on a drum base made of aluminum, and is driven to rotate in the direction of the arrow C of FIG. 1 by a driving device (not illustrated) at a predetermined process speed.

In addition, a charging roller 11 as a charging portion uniformly charges the surface of the photosensitive drum 10 to a predetermined negative potential by a charging bias voltage applied from a charging bias power source (not illustrated). In the first embodiment, reversely developing exposed portions on the surface of the photosensitive drum 10, a so-called reversal developing system, is used and thus the potential of the charge is negative.

The charged part of the surface of the photosensitive drum 10 is scanned and exposed by a laser light L which is modulated according to a time-series electrical digital pixel signal of the image information output from a laser scanner 12 as an exposing portion, and an electrostatic latent image corresponding to the image information is formed on the surface of the photosensitive drum 10. In the exposed area of the surface of the photosensitive drum 10, the potential of the surface of the photosensitive drum 10 is neutralized, and thus the potential of the surface of the photosensitive drum 10 becomes relatively positive compared to the surroundings. Therefore, the electrostatic latent image corresponding to the image information is formed on the surface of the photosensitive drum 10.

A developing device 13 allows negatively charged toner as a developer to adhere to the electrostatic latent image formed on the surface of the photosensitive drum 10, thereby developing a toner image. As a developing method using the developing device 13, for example, there is a method in which a mixture of toner particles and magnetic carriers is used as a developer and the developer is attracted by a magnetic force to come into contact with the surface of the photosensitive drum 10 so as to be developed.

The transfer roller 16 as the transfer portion is formed of an elastic member, abuts on the surface of the photosensitive drum 10, and a transfer bias voltage is applied to the transfer roller 16 when transferring is performed.

The recording material P to which the toner image is transferred passes through the discharge device 20 and is discharged to the outside of the body of the image forming apparatus 25, after the toner image is thermally fixed by the fixing device 17.

The remaining transfer toner on the surface of the photosensitive drum 10 is cleaned by a cleaning device 21, thereby completing the series of image forming processes. An image forming section which forms an image on the recording material P includes the photosensitive drum 10, the charging roller 11, the laser scanner 12, the developing device 13, the transfer roller 16, the fixing device 17, and the like.

Discharge Device

Figure 2:
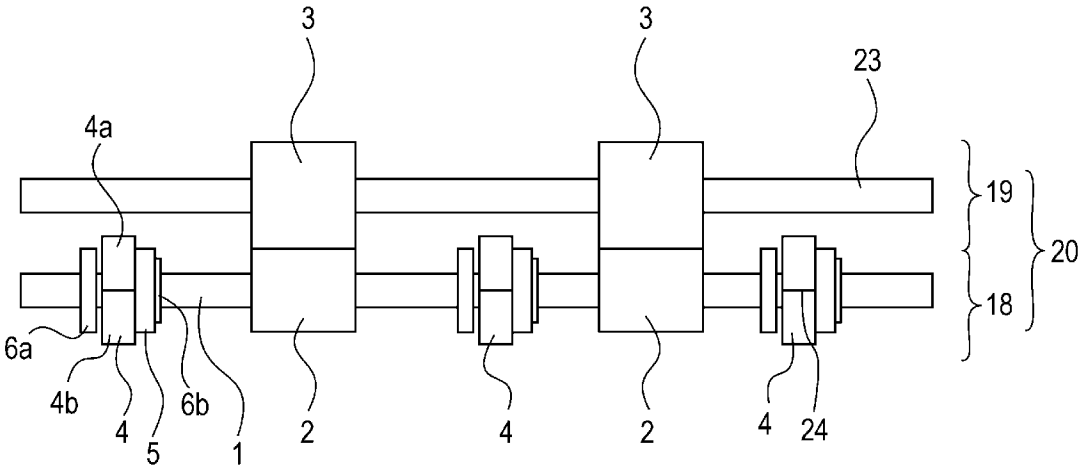
FIG. 2 is a front view illustrating the configuration of a first embodiment of the discharge device according to the present invention.

The configuration of the discharge device 20 of the first embodiment will now be described with reference to FIGS. 2 to 4. FIG. 2 is a front view of the discharge device 20 when viewed in a conveyance direction G of the recording material P. As illustrated in FIG. 2, the discharge device 20 is configured to include a discharge driving section 18 and a discharge follower section 19.

In the discharge driving section 18, a driving shaft 1 which is driven to rotate by a driving source such as a motor (not illustrated) is provided, and discharge rollers 2 as a plurality of driving rotating members which is attached to the driving shaft 1 (to the driving shaft) at intervals are provided to rotate integrally with the driving shaft 1. In addition, stiffening rollers 4 as a plurality of stiffening rotating members are arranged on the driving shaft 1 at positions where the discharge rollers 2 are not provided. The stiffening rollers 4 are rotatably attached to the driving shaft 1. The discharge driving section 18 includes the driving shaft 1, the discharge rollers 2, and the stiffening rollers 4.

Figure 3A:
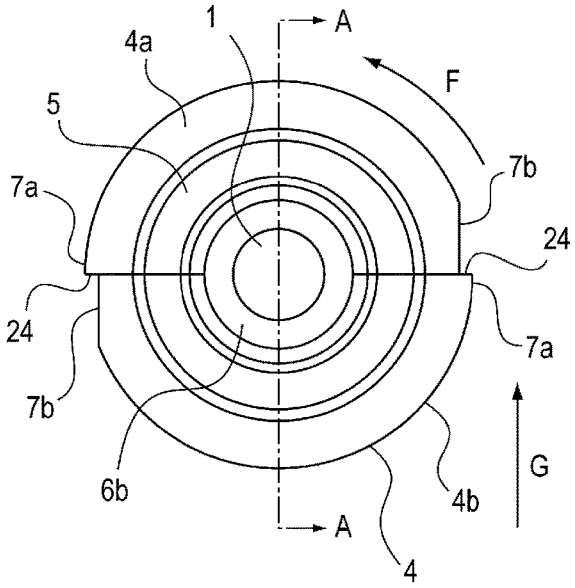
FIG. 3A is a side view of a stiffening rotating member of the discharge device of the first embodiment when viewed in an axial direction.
Figure 4A:
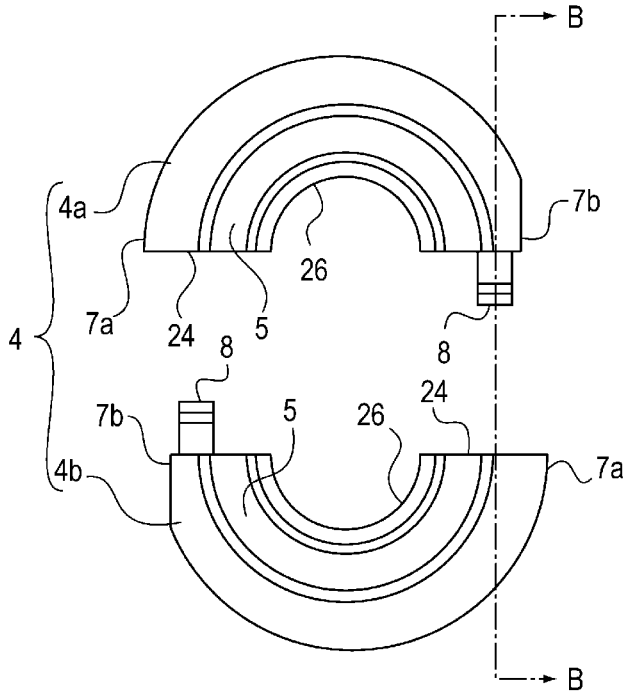
FIG. 4A is an exploded side view of the stiffening rotating member of the discharge device of the first embodiment when viewed in the axial direction.

The stiffening roller 4 is configured to have a larger outside diameter than that of the discharge roller 2. A bend is formed in the recording material P by the difference between the outside diameters of the stiffening roller 4 and the discharge roller 2. Accordingly, the recording material P has a wave shape when viewed from the downstream side in the conveyance direction, and thus loading characteristics of the recording materials P after being discharged to the outside of the image forming apparatus 25 are enhanced. As illustrated in FIGS. 3A and 4A, the stiffening roller 4 has a disc shape by joining at least two divided components 4*a* and 4*b*.

The discharge follower section 19 is configured to include a support shaft 23 which is disposed to be substantially parallel to the driving shaft 1 and follower rollers 3 as follower rotating members which are rotatably supported by the support shaft 23 and are pressed against the discharge rollers 2. The follower rollers 3 are respectively pressed against the discharge rollers 2 by biasing springs (not illustrated) or the like. The follower rollers 3 are rotated as the discharge rollers 2 rotate. The recording material P passes between the discharge roller 2 and the follower roller 3, and thus the recording material P is conveyed to the outside of the image forming apparatus 25.

Figure 4B:
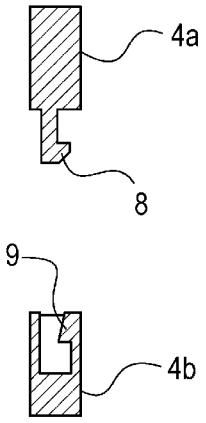
FIG. 4B is a cross-sectional view taken along the line B-B of FIG. 4A.

As illustrated in FIG. 4A, the stiffening roller 4 is formed to be divided into the semicircular components 4*a* and 4*b*. Accordingly, even after the discharge roller 2 is joined to the driving shaft 1, the components 4*a* and 4*b* can be attached to the driving shaft 1, and thus a characteristic of assembling the stiffening roller 4 to the driving shaft 1 is enhanced. Bearing fitting portions 26 of the components 4*a* and 4*b* are fitted to the outer circumferential surface of the driving shaft 1 from both sides of the driving shaft 1 in the radial direction, and projections 8, as locking portions, which are provided to protrude from one end surfaces of boundary portions 24 of the components 4*a* and 4*b* illustrated in FIGS. 4A and 4B, are locked to hook portions 9 which are provided in the other end surfaces. Therefore, the boundary portions 24 of the components 4*a* and 4*b* can be joined and assembled to each other.

In the first embodiment, as illustrated in FIGS. 4A and 4B, the stiffening roller 4 which is formed to be divided into the semicircular components 4*a* and 4*b* includes, as the locking portions, the projections 8 and the hook portions 9 in the end surfaces of the boundary portions 24 of the components 4*a* and 4*b* so as to be detachably attachable to each other. The projection 8 is configured to elastically deform so as to be locked to the hook portion 9.

By fitting the bearing fitting portions 26 of the components 4*a* and 4*b* from both sides of the driving shaft 1 in the radial direction as well as hooking the projection 8 and the hook portion 9 to each other so as to be locked to each other, the components 4*a* and 4*b* are joined together to form a disc shape. Note that the method of joining the semicircular components 4*a* and 4*b* is not limited to the joining by the projection 8 and the hook portion 9. Completely fixing with an adhesive, screwing, and the like may also be employed as the joining method.

FIG. 3A is a side view of the discharge driving section 18 illustrated in FIG. 2 when viewed from the right of FIG. 2 in the direction of the driving shaft 1. As illustrated in FIG. 3A, in the boundary portions 24 of the divided components 4*a* and 4*b* of the stiffening roller 4, stepped portions 7*a* which protrude in the radial direction of the stiffening roller 4 are provided on the upstream sides in the rotation direction of the stiffening roller 4 indicated by the direction of the arrow F of FIG. 3A. In the first embodiment, as illustrated in FIG. 3A, cutout portions 7*b* which are formed by cutting out curved portions in parts connected to the stepped portions 7*a* to have flat surfaces are provided in the boundary portions 24 of the divided components 4*a* and 4*b* of the stiffening roller 4. Therefore, the stepped portions 7*a* protrude in the radial direction of the stiffening roller 4.

As a result, as illustrated in FIG. 3A, the recording material P first comes into contact with the stepped portion 7*a*, which protrudes in the radial direction of the stiffening roller 4, and is pushed by the stepped portion 7*a* such that the travelling direction thereof is controlled. Therefore, the front end of the recording material P is not inserted into a gap caused by a backlash between the boundary portions 24 of the divided components 4*a* and 4*b* of the stiffening roller 4, and thus the front end is not interposed nor caught therebetween.

Figure 6:
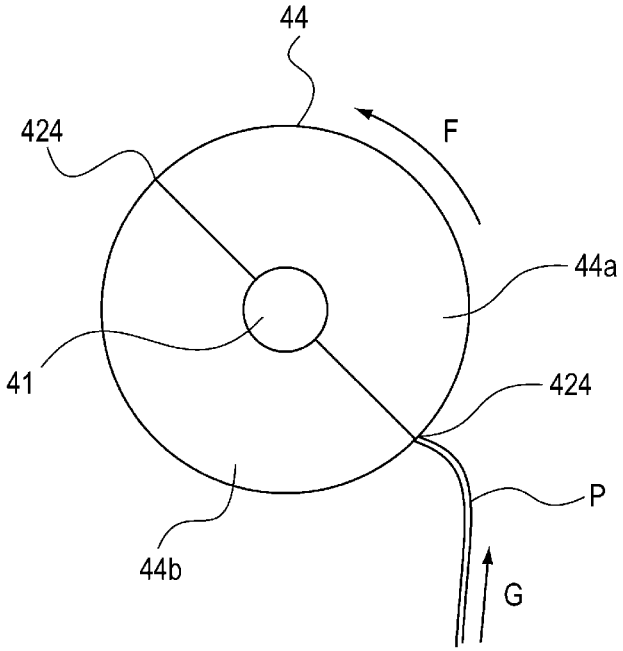
FIG. 6 is a view illustrating a state where a recording material is interposed between boundary portions having a gap, which is caused by a backlash of divided components of the stiffening rotating member.

FIG. 6 illustrates a comparative example. As illustrated in FIG. 6, a stiffening roller 44 is formed to be divided into semicircular components 44*a* and 44*b*. In the comparative example of FIG. 6, when the stiffening roller 44 which is formed to be divided is assembled to a driving shaft 41, a gap between boundary portions 424 of the divided components 44*a* and 44*b* is formed. The outside diameter of the stiffening roller 44 is configured to be larger than that of the discharge roller 2, and thus the recording material P first comes into contact with the stiffening roller 44.

At this time, as illustrated in FIG. 6, there is a possibility that the recording material P may be interposed or caught between the boundary portions 424 having a gap caused by a backlash of the divided components 44*a* and 44*b*. As a result, there may be a case where a jam of the recording material P or a scratch on the recording material P occurs. To the contrary, in the first embodiment, as illustrated in FIG. 3A, the stepped portions 7*a* which protrude in the radial direction of the stiffening roller 4 are formed in the boundary portions 24. Therefore, there is less concern of the front end of the recording material P being caught on the boundary portions 24. Therefore, a jam of the recording material P or a scratch on the recording material P is less likely to occur.

Furthermore, so as not to cause the recording material P to be interposed in the gap caused by a backlash between the boundary portions 24 of the divided components 4*a* and 4*b* of the stiffening roller 4, the stepped portions 7*a* which protrude in the radial direction of the stiffening roller 4 need to be configured to first come into contact with the recording material P. To this end, the stepped portions 7*a*, which protrude in the radial direction of the stiffening roller 4, need to be disposed on the upstream sides in the rotation direction of the stiffening roller 4 indicated by the direction of the arrow F of FIG. 3A. The configuration for the above disposition will be described with reference to FIG. 3B.

Figure 3B:
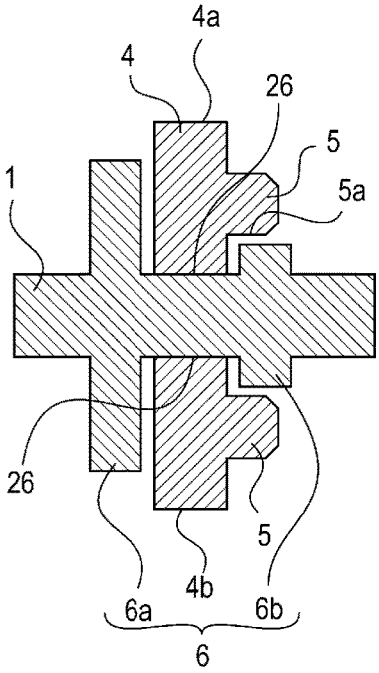
FIG. 3B is a cross-sectional view taken along the line A-A of FIG. 3A.

FIG. 3B is a cross-sectional view taken along the line A-A of FIG. 3A. As illustrated in FIG. 3B, in order to restrict the movement of the stiffening roller 4 in the axial direction (horizontal direction of FIG. 3B), at least two protrusions 6*a* and 6*b*, as first protrusions, which protrude in the radial direction of the stiffening roller 4 on both sides of the stiffening roller 4 are provided on the driving shaft 1 (on the driving shaft). Accordingly, the stiffening roller 4 is interposed between the protrusions 6*a* and 6*b* such that the movement thereof in the direction of the driving shaft 1 (horizontal direction of FIG. 3B) is restricted.

The protruding amounts of the protrusions 6*a* and 6*b* in the radial direction of the stiffening roller 4 on both sides of the stiffening roller 4 are different. In the first embodiment, the protruding amount of the protrusion 6*a* in the radial direction of the stiffening roller 4 is set to be larger than that of the protrusion 6*b* in the radial direction of the stiffening roller 4. The protrusions 6*a* and 6*b* of the first embodiment are formed in disk shapes having different outside diameters.

On the other hand, protrusions 5 as second protrusions which protrude in the axial direction are provided on at least one side surface of the stiffening roller 4 in the axial direction. The protrusions 5 of the first embodiment are formed in a continuous circular shape in which the rotation center (the driving shaft 1) of the stiffening roller 4 is the center thereof. As illustrated in FIG. 3A, in the boundary portions 24 of the divided components 4*a* and 4*b* of the stiffening roller 4, the stepped portions 7*a* which protrude in the radial direction of the stiffening roller 4 are assembled to be disposed on the upstream sides in the rotation direction of the stiffening roller 4 indicated by the direction of the arrow F of FIG. 3A. At this time, as illustrated in FIG. 3B, the protrusions 6*b*, which are provided to protrude from the outer circumferential surface of the driving shaft 1 and have a small protruding amount, are fitted to be disposed closer to the driving shaft 1 than to inner circumferential surfaces 5*a* of the protrusions 5 which are provided to protrude from one side surface of the stiffening roller 4 and have a ring shape.

Although not illustrated, it is assumed that the boundary portions 24 of the divided components 4*a* and 4*b* of the stiffening roller 4 are assembled so that the stepped portions 7*a*, which protrude in the radial direction of the stiffening roller 4, are disposed on the downstream sides in the rotation direction of the stiffening roller 4 indicated by the direction of the arrow F of FIG. 3A. At this time, in FIG. 3A, the assembly is performed so that the rotation direction of the stiffening roller 4 is opposite to the direction of the arrow F of FIG. 3A. In this case, the protrusions 5 of the stiffening roller 4 illustrated in FIG. 3B, face the left side of FIG. 3B. In addition, the protrusions 6*a*, which are provided to protrude from the outer circumferential surface of the driving shaft 1 and have a large protruding amount, interfere with the protrusions 5 which are provided to protrude from one side surface of the stiffening roller 4 and have a ring shape. Thus, the assembly cannot be performed.

In this configuration, the divided components 4*a* and 4*b* of the stiffening roller 4 can be prevented from being incorrectly assembled. In addition, the stepped portions 7*a* which protrude in the radial direction of the stiffening roller 4 can be disposed in the boundary portions 24 of the divided components 4*a* and 4*b* of the stiffening roller 4, on the upstream sides in the rotation direction of the stiffening roller 4 indicated by the direction of the arrow F of FIG. 3A.

Accordingly, the stepped portions 7*a*, which protrude in the radial direction of the stiffening roller 4 in the boundary portions 24 of the divided components 4*a* and 4*b* of the stiffening roller 4, can first come into contact with the recording material P. Accordingly, the front end of the recording material P is not inserted into a gap caused by a backlash between the boundary portions 24 of the divided components 4*a* and 4*b* of the stiffening roller 4, and thus the front end is not interposed nor caught therebetween.

According to the above-described configuration, the stiffening roller 4 which is formed to be divided is prevented from being assembled in an incorrect direction. The occurrence of a jam of the recording material P or a scratch on the recording material P, which is caused by the recording material P being interposed in a gap caused by a backlash between the boundary portions 24 of the divided components 4*a* and 4*b* of the stiffening roller 4, can be prevented.

Note that the protrusions 6*a* and 6*b*, which protrude from the outer circumferential surface of the driving shaft 1 in the radial direction, are merely examples. Additionally, for example, a shaft made of metal such as a spring pin may be press-fitted to the outer circumferential surface of the driving shaft 1. Moreover, forming asymmetric members on the outer circumferential surface of the driving shaft 1 to interpose the stiffening roller 4 therebetween can have the same effect.

Second Embodiment

Next, the configuration of a second embodiment of an image forming apparatus provided with a discharge device according to the present invention will be described with reference to FIG. 5. Configurations identical with those in the first embodiment are denoted by like reference numerals or like member names, even with different reference numerals, and description thereof will not be repeated.

Figure 5B:
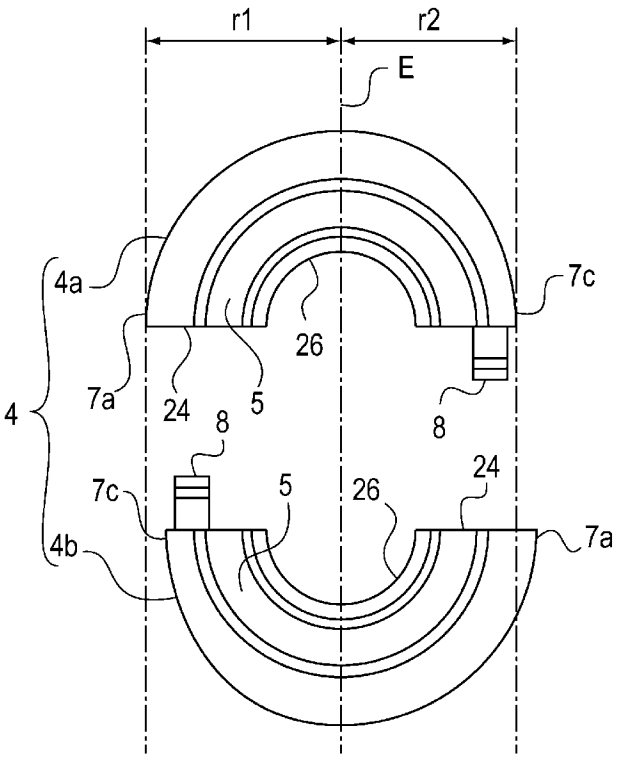
FIG. 5B is an exploded side view of the stiffening rotating member of the discharge device of the second embodiment when viewed in the axial direction.
Figure 5A:
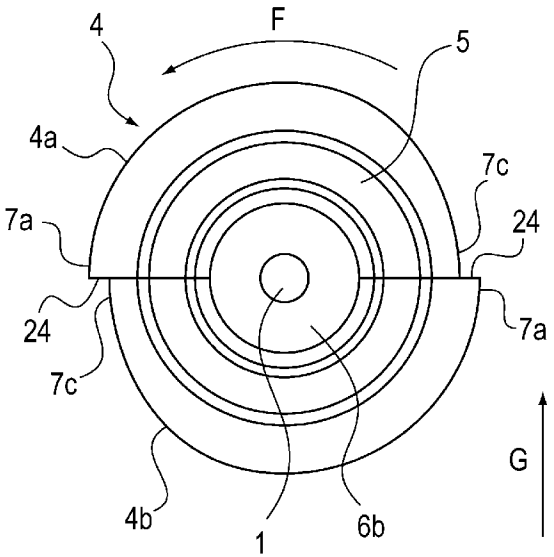
FIG. 5A is a side view of a stiffening rotating member of a second embodiment of the discharge device according to the present invention when viewed in the axial direction.

In the first embodiment, in order to provide the stepped portions 7*a* which protrude in the radial direction of the stiffening roller 4 in the boundary portions 24 of the divided components 4*a* and 4*b* of the stiffening roller 4, the cutout portions 7*b* which are formed by cutting out the curved portions in the parts connected to the stepped portions 7*a* to have flat surfaces are provided. In the second embodiment, as illustrated in FIGS. 5A and 5B, in boundary portions 24 of divided components 4*a* and 4*b* of a stiffening roller 4, distances r1 and r2 from a rotation center E of the stiffening roller 4 to outer circumferential surfaces in the radial direction of the stiffening roller 4 are set to be different.

In the second embodiment, the distance r1 from the rotation center E of the stiffening roller 4 to the stepped portions 7*a*, which protrude in the radial direction of the stiffening roller 4 in the boundary portions 24 of the divided components 4*a* and 4*b* of the stiffening roller 4, is as follows. That is, the distance r1 is set to be larger than the distance r2 from the rotation center E to stepped portions 7*c* which are recessed in the radial direction of the stiffening roller 4.

As described above, the distances r1 and r2 are set to be: r1>r2. Accordingly, the stepped portions 7*a*, which protrude in the radial direction of the stiffening roller 4 in the boundary portions 24 of the divided components 4*a* and 4*b* of the stiffening roller 4, first come into contact with a recording material P. Accordingly, a front end of the recording material P is not inserted into a gap caused by a backlash between the boundary portions 24 of the divided components 4*a* and 4*b* of the stiffening roller 4, and thus the front end is not interposed nor caught therebetween. The other configurations are the same as those of the first embodiment, and the same effect can be obtained.

In both of the first and second embodiments, the stiffening roller 4 which is divided into two parts is exemplified. However, a component which is divided into three or four parts in the circumferential direction may also be used.

While the present invention has been described with reference to exemplary embodiments, it is to be understood that the invention is not limited to the disclosed exemplary embodiments. The scope of the following claims is to be accorded the broadest interpretation so as to encompass all such modifications, equivalent structures and functions.

This application claims the benefit of Japanese Patent Application No. 2013-169328, filed Aug. 19, 2013, which is hereby incorporated by reference herein in its entirety.

What is claimed is:

1. A discharge device which discharges a sheet, the discharge device comprising:

a shaft which is driven to rotate by a driving force transmitted from a driving source;

a driving roller configured to convey and discharge the sheet, the driving roller being provided on the shaft and rotating with the shaft; and a rotating member provided on the shaft and having an outer circumferential surface which contacts the sheet, the rotating member being rotatable with respect to the shaft and including a first rotating part and a second rotating part adjacent to the first rotating part with respect to a rotating direction of the rotating member, a downstream end surface of the first rotating part adjoins an upstream end surface of the second rotating part with respect to the rotating direction of the rotating member in a boundary between the first rotating part and the second rotating part, and a downstream end surface of the second rotating part adjoins an upstream end surface of the first rotating part with respect to the rotating direction of the rotating member in the boundary between the first rotating part and the second rotating part, wherein when the rotating member is viewed in an axial direction of the shaft, a distance between a rotation center of the shaft and an outermost edge of the downstream end surface of the first rotating part is greater than a distance between the rotation center of the shaft and an outermost edge of the upstream end surface of the second rotating part, and a distance between the rotation center of the shaft and an outermost edge of the downstream end surface of the second rotating part is greater than a distance between the rotation center of the shaft and an outermost edge of the upstream end surface of the first rotating part, and wherein when the rotating member is viewed in the axial direction of the shaft, an entirety of the outer circumferential surface of the rotating member has an outer diameter greater than an outer diameter of an outer circumferential surface of the driving roller, and the outer circumferential surface of the rotating member, except for the vicinity of the boundary, does not have a protruding portion or a recessed portion.

2. The discharge device according to claim 1, further comprising a follower rotating member which is pressed against the driving roller.

3. The discharge device according to claim 1, wherein the difference between the outer diameter of the rotating member and the outer diameter of the driving roller forms bend on the sheet.

4. The discharge device according to claim 1, wherein the first rotating part and the second rotating part are both semicircular.

5. The discharge device according to claim 1, wherein one of the first rotating part and the second rotating part has one of a projection and a hook portion on its end surface, and the other of the first rotating part and the second rotating part has the other of the projection and the hook portion on its end surface.

6. The discharge device according to claim 5, wherein the projection is configured to deform and engage with the hook portion.

7. A discharge device which discharges a sheet, the discharge device comprising:

a shaft which is driven to rotate by a driving force transmitted from a driving source;

a driving roller configured to convey and discharge the sheet, the driving roller being provided on the shaft and rotating with the shaft; and a rotating member provided on the shaft and having an outer circumferential surface which contacts the sheet, the rotating member being rotatable with respect to the shaft and including a first rotating part and a second rotating part adjacent to the first rotating part with respect to a rotating direction of the rotating member, a downstream end surface of the first rotating part adjoins an upstream end surface of the second rotating part with respect to the rotating direction of the rotating member in a boundary between the first rotating part and the second rotating part, and a downstream end surface of the second rotating part adjoins an upstream end surface of the first rotating part with respect to the rotating direction of the rotating member in the boundary between the first rotating part and the second rotating part, wherein when the rotating member is viewed in an axial direction of the shaft, a distance between a rotation center of the shaft and an outermost edge of the downstream end surface of the first rotating part is greater than a distance between the rotation center of the shaft and an outermost edge of the upstream end surface of the second rotating part, and a distance between the rotation center of the shaft and an outermost edge of the downstream end surface of the second rotating part is greater than a distance between the rotation center of the shaft and an outermost edge of the upstream end surface of the first rotating part, and wherein when the rotating member is viewed in the axial direction of the shaft, an entirety of the outer circumferential surface of the rotating member has an outer diameter greater than an outer diameter of an outer circumferential surface of the driving roller, and the second rotating part has no protruding portion facing the outermost edge of the downstream end surface of the first rotating part with respect to the rotating direction of the rotating member.

8. The discharge device according to claim 7, further comprising a follower rotating member which is pressed against the driving roller.

9. The discharge device according to claim 7, wherein the difference between the outer diameter of the rotating member and the outer diameter of the driving roller forms bend on the sheet.

10. The discharge device according to claim 7, wherein the first rotating part and the second rotating part are both semicircular.

11. The discharge device according to claim 7, wherein one of the first rotating part and the second rotating part has one of a projection and a hook portion on its end surface, and the other of the first rotating part and the second rotating part has the other of the projection and the hook portion on its end surface.

12. The discharge device according to claim 11, wherein the projection is configured to deform and engage with the hook portion.

* * * * *